US008207812B2

(12) United States Patent
Roc et al.

(10) Patent No.: US 8,207,812 B2
(45) Date of Patent: Jun. 26, 2012

(54) SYSTEM FOR ISOLATING A MEDIUM VOLTAGE

(75) Inventors: Albert Roc, Pittsburgh, PA (US); Peter Willard Hammond, Greensburg, PA (US)

(73) Assignee: Siemens Industry, Inc., Alpharetta, GA (US)

( * ) Notice: Subject to any disclaimer, the term of this patent is extended or adjusted under 35 U.S.C. 154(b) by 165 days.

(21) Appl. No.: 12/349,935

(22) Filed: Jan. 7, 2009

(65) Prior Publication Data

US 2009/0174516 A1 Jul. 9, 2009

Related U.S. Application Data

(60) Provisional application No. 61/019,994, filed on Jan. 9, 2008, provisional application No. 61/019,962, filed on Jan. 9, 2008.

(51) Int. Cl.
*H01F 27/30* (2006.01)
*H01F 27/36* (2006.01)

(52) U.S. Cl. ..... 336/205; 336/84 R; 336/90; 336/208

(58) Field of Classification Search ..... 336/212, 336/69, 82, 84 R, 90, 92, 96, 196, 198, 205, 336/208; 174/350, 352, 353
See application file for complete search history.

(56) References Cited

U.S. PATENT DOCUMENTS 2,547,649 A * 4/1951 Marsh ..... 336/84 R
2,731,607 A * 1/1956 Gould et al. ..... 336/96
2,941,905 A * 6/1960 Hofmann ..... 428/329
3,039,042 A * 6/1962 Chatterton ..... 323/355
3,244,960 A * 4/1966 Stevens et al. ..... 363/126
3,403,366 A * 9/1968 Klatte et al. ..... 336/92
3,548,357 A * 12/1970 Peckham ..... 336/205
4,197,992 A * 4/1980 Klebanoff ..... 236/46 R
4,318,067 A * 3/1982 Weiner ..... 336/90
4,353,502 A * 10/1982 Myers ..... 236/47
4,464,544 A * 8/1984 Klein ..... 381/111
4,636,910 A * 1/1987 Chadwick ..... 361/103
4,660,014 A * 4/1987 Wenaas et al. ..... 336/84 C
4,683,518 A * 7/1987 Gwozdz ..... 361/263
4,817,862 A * 4/1989 Bhattacharya ..... 236/10
5,025,489 A * 6/1991 Yamaguchi ..... 219/760
5,034,854 A * 7/1991 Matsumura et al. ..... 361/744
5,056,214 A * 10/1991 Holt ..... 29/602.1
5,090,048 A 2/1992 Blake
5,241,152 A 8/1993 Anderson et al.
5,317,300 A * 5/1994 Boesel ..... 336/96
5,589,808 A * 12/1996 Clark et al. ..... 336/92
5,633,019 A * 5/1997 Clark et al. ..... 425/116
5,638,263 A 6/1997 Opal et al.
5,646,498 A 7/1997 Lipo et al.
5,905,642 A 5/1999 Hammond
5,977,855 A * 11/1999 Matsumura et al. ..... 336/96
6,151,288 A 11/2000 Takei et al.
6,221,297 B1 * 4/2001 Lanoue et al. ..... 264/219
6,222,284 B1 4/2001 Hammond et al.
6,369,681 B1 * 4/2002 Lin ..... 336/192
6,682,681 B1 * 1/2004 Clark et al. ..... 264/263
6,787,704 B2 * 9/2004 Owen ..... 174/167
6,867,564 B1 3/2005 Wu et al.
6,879,372 B1 4/2005 Takaragi et al.
6,879,500 B2 4/2005 Liu et al.
7,132,812 B1 11/2006 Wu et al.
7,498,917 B1 * 3/2009 Yang ..... 336/90

* cited by examiner

*Primary Examiner* — Anh Mai
*Assistant Examiner* — Joselito Baisa

(57) ABSTRACT

A signal isolating transformer may be arranged such that a first coil of the signal isolating transformer is located in a medium voltage compartment and a second coil of the signal isolating transformer is located external to the medium voltage compartment. The transformer spans an opening defined by a grounded wall to isolate faults in the medium voltage compartment.

16 Claims, 6 Drawing Sheets

SYSTEM FOR ISOLATING A MEDIUM VOLTAGE

CLAIM OF PRIORITY AND RELATED APPLICATIONS

This patent application claims priority to U.S. Provisional Patent No. 61/019,994 entitled "A Method for Isolating a Medium Voltage," filed on Jan. 9, 2008 and U.S. Provisional Patent No. 61/019,962, entitled "Signal Isolating Transformer and System Including Same" filed on Jan. 9, 2008, which are hereby incorporated by reference in their entirety.

BACKGROUND

The disclosed embodiments relate generally to methods and systems for isolating a medium voltage.

Electrically alternating current (AC) power is generally available at several different standardized voltage levels. Levels up to approximately 600 volts may be classified as low voltage (LV). Levels above approximately 69,000 volts may be classified as transmission voltages. Levels between LV and transmission voltages may be classified as medium voltage (MV).

Electrical equipment of a high power rating may be fed from MV power. MV power presents hazards of electrocution and flash burns. Therefore, safety codes generally require that access to MV power be restricted to trained service personnel. In order to restrict the access to MV power, portions of equipment containing MV circuits may be enclosed in a metal compartment or located in a restricted room or vault. As used herein, a compartment, room, vault, or other structure that physically separates some or all components of an MV circuit from non-MV components are referred to as a medium voltage compartment. The portions of the equipment containing MV circuits may be considered to be on the MV side of the equipment, whereas the portions of the equipment only containing LV circuits, and therefore having less restricted access, may be considered to be on the LV side of the equipment.

Electrical equipment fed by MV power may also contain LV devices for protection or control. LV devices may include, but are not limited to, thermostats. The LV devices may be wired into LV circuits which may include interface devices that can be touched by a human operator. Interface devices may include, but are not limited to, switches, pilot lights, meters, display screens, etc.

Safety codes generally require that protective means be provided to prevent the MV power from invading the LV circuits, even during an arcing fault in the MV circuits. Such protective means may include separating the LV wiring from the MV wiring by a metal barrier with a specified minimum thickness. At the specified minimum thickness, the metal barrier is able to resist being melted by plasma or radiation from an MV arcing fault for a time interval long enough that the fault will first be cleared by MV protective devices such as, for example, fuses, circuit breakers, etc.

FIG. 1 illustrates a simplified representation of a prior art apparatus 100 (e.g., electrical equipment of a high power rating) which includes at least one MV circuit 161 including MV wiring and other MV components, and at least one LV circuit 150 including LV wiring and other LV components. The MV circuit 161 is contained within a MV compartment 110 located on a MV side of the apparatus, and the LV circuit 150 is contained within both the MV compartment 110 and a LV compartment 130. The MV compartment includes a grounded metal wall 112 which functions to isolate the MV compartment from the LV compartment. The MV compartment 110 may also contain one or more MV devices 162.

One of the LV circuits 150 includes a plurality of series-connected normally-closed LV thermostats 131-134 which are installed in the MV compartment 110, and a LV relay 136 (e.g., over-temperature relay) which is installed in the LV compartment 130 and is connected in series with the LV thermostats 131-134. The LV thermostats 131-134 are utilized to monitor the temperatures of critical components in the MV compartment 110, and the LV relay is utilized to open or close one or more LV control circuits in the LV compartment 130.

In operation, 120 VAC control power 140 from the LV compartment is applied through the normally-closed LV thermostats 131-134 to the LV relay 136, thereby energizing the LV relay 136 and moving the contacts of the LV relay 136 to a closed position which closes a control circuit 138 in the LV compartment. If any of the LV thermostats 131-134 detects an excessive temperature, the given LV thermostat opens, thereby de-energizing the LV relay 136 and moving the contacts of the LV relay 136 to an open position which opens the LV control circuit 138 in the LV compartment 130. The opening of the LV control circuit 138 causes an alarm 142 signal to be generated. In response to the alarm signal, or in the alternative, a warning message may be displayed, the power may be interrupted, etc.

As shown in FIG. 1, the LV wiring 150, which carries the 120 VAC control power, passes through the grounded metal wall 112 of the MV compartment. When an arcing fault in a MV circuit (for example, 161) occurs, plasma 160 resulting from the arcing fault may contact the LV circuit which includes the LV thermostats 131-134 and the LV wiring 150 in the MV compartment 110. When the plasma 160 contacts the LV thermostats 131-134 or the LV wiring 150, the high temperature and/or high voltage of the plasma 160 may cause the insulation of the LV thermostats 131-134 and/or LV wiring 150 to fail. The failure of the insulation may create a direct connection 170 between the MV circuit 161 and the LV circuit 150 via the plasma 160, thereby applying MV to the LV thermostats 131-134, the LV wiring, and to other LV components connected thereto. As the devices and wiring in such LV circuits are generally not sufficiently insulated to withstand the far greater MV, their insulation may also break down at locations not directly exposed to the plasma. The MV may continue to jump from one LV circuit to another LV circuit in the above-described manner until the MV reaches a human interface device 180 and creates a potentially lethal shock hazard.

To minimize the risk associated with potential arcing faults, each LV device located in the MV compartment 110 may be enclosed in a grounded metal box, and all LV wiring located in the MV compartment 110 may be run in grounded metal conduit. For such implementations, the metal in the grounded metal boxes and in the conduit would be of a thickness sufficient to resist being melted by plasma or radiation of the MV arcing fault for a desired time interval. However, such configurations tend to be difficult and expensive to implement, especially so for applications having numerous LV devices located in the MV compartment and/or LV devices in scattered locations in the MV compartment.

SUMMARY

In an embodiment, an electrical system includes a medium voltage compartment having at least one wall that defines an opening. A signal isolating transformer includes a core having a first leg and a second leg, a first coil wound around the first leg, and a second coil wound around the second leg. A conductive plate is connected to the wall and the core is positioned between the first coil and second coil, and covers the opening. The first coil may be located in the medium voltage compartment, and the second coil may be located external to the medium voltage compartment, such as in a low voltage compartment. The metal plate may be electrically bonded to the core. The first and second coils may have the same or differing numbers of turns. Optionally, a tuning capacitor may be electrically connected in parallel to either the first coil or the second coil.

A set of low voltage thermostats may be positioned within the medium voltage compartment so that the first coil is electrically connected to the thermostats. The thermostats may function such that the opening of any of the thermostats causes the impedance of the second coil to increase. A low voltage relay may be electrically connected to the second coil. If so, the thermostats function such that opening of any of the thermostats causes contacts of the relay to move.

In an alternate embodiment, a signal isolating transformer includes a core having a first leg and a second leg, a first coil wound around the first leg, a second coil wound around the second leg, and a metal plate connected to the core. The metal plate is positioned between the first coil and the second coil and extends past the core. The first coil is located in a medium voltage compartment, the second coil is located external to the medium voltage compartment, and the metal plate covers an opening in a grounded metal wall of the medium voltage compartment to prevent plasma from passing from the first coil in the medium voltage compartment to the second coil external to the medium voltage compartment. The first and second coils may have the same or differing numbers of turns. Optionally, a tuning capacitor may be electrically connected in parallel to either the first coil or the second coil.

In an alternate embodiment, an electrical system includes a medium voltage compartment that includes a wall that defines an opening. A signal isolating transformer includes a core, a first coil wound around a first portion of the core, a second coil wound around a second portion of the core, and a molded case that encapsulates the first and second coils and the core. The case positions the first coil to one side of the wall and the second coil to an opposing side of the wall, so that the molded case comprises a flange which covers the opening. The signal isolating transformer also may include one or more conductive inserts electrically connected to the core inside the molded case, which serve to provide a path from the core to ground. The first and second coils may have the same or differing numbers of turns. Optionally, a tuning capacitor may be electrically connected in parallel to either the first coil or the second coil.

BRIEF DESCRIPTION OF THE DRAWINGS

Aspects, features, benefits and advantages of the embodiments described herein will be apparent with regard to the following description, appended claims, and accompanying drawings where:

DETAILED DESCRIPTION

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Also, it is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Figure 1:
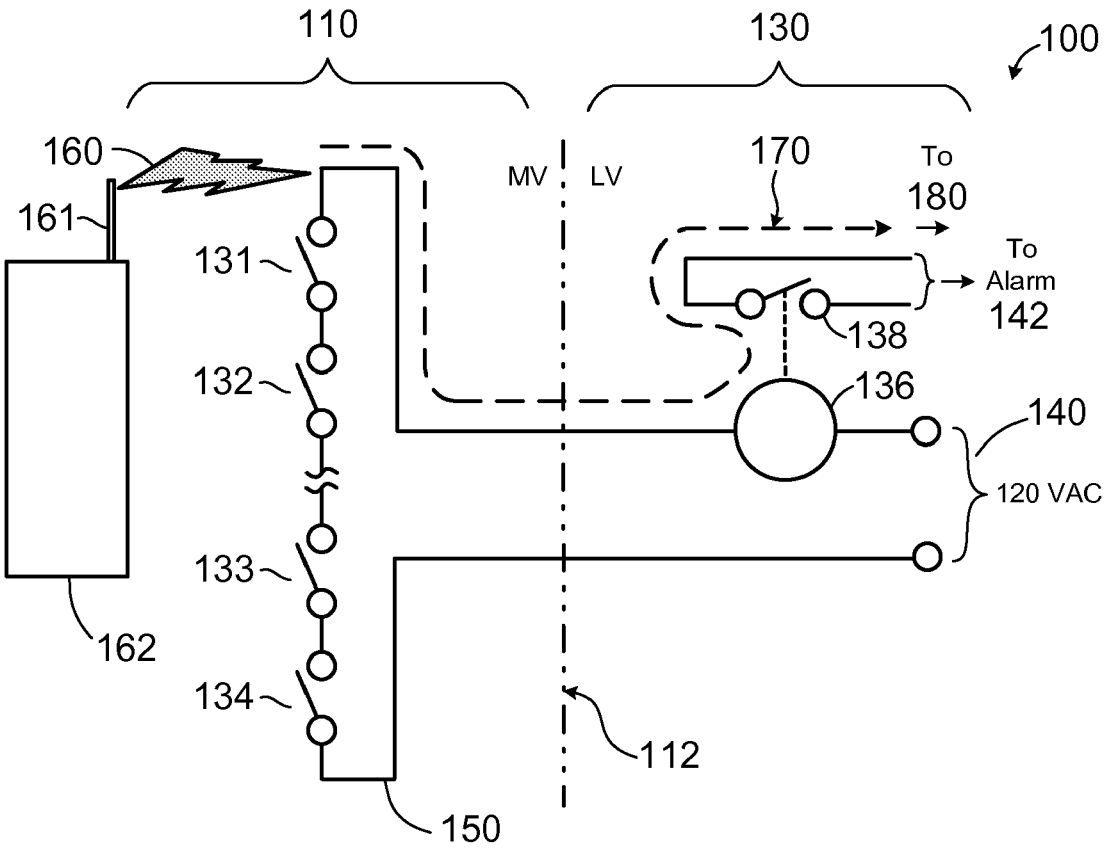
FIG. 1 PRIOR ART
FIG. 1 illustrates a simplified representation of a prior art apparatus (e.g., electrical equipment of a high power rating) which includes at least one MV circuit and at least one LV circuit.
Figure 2:
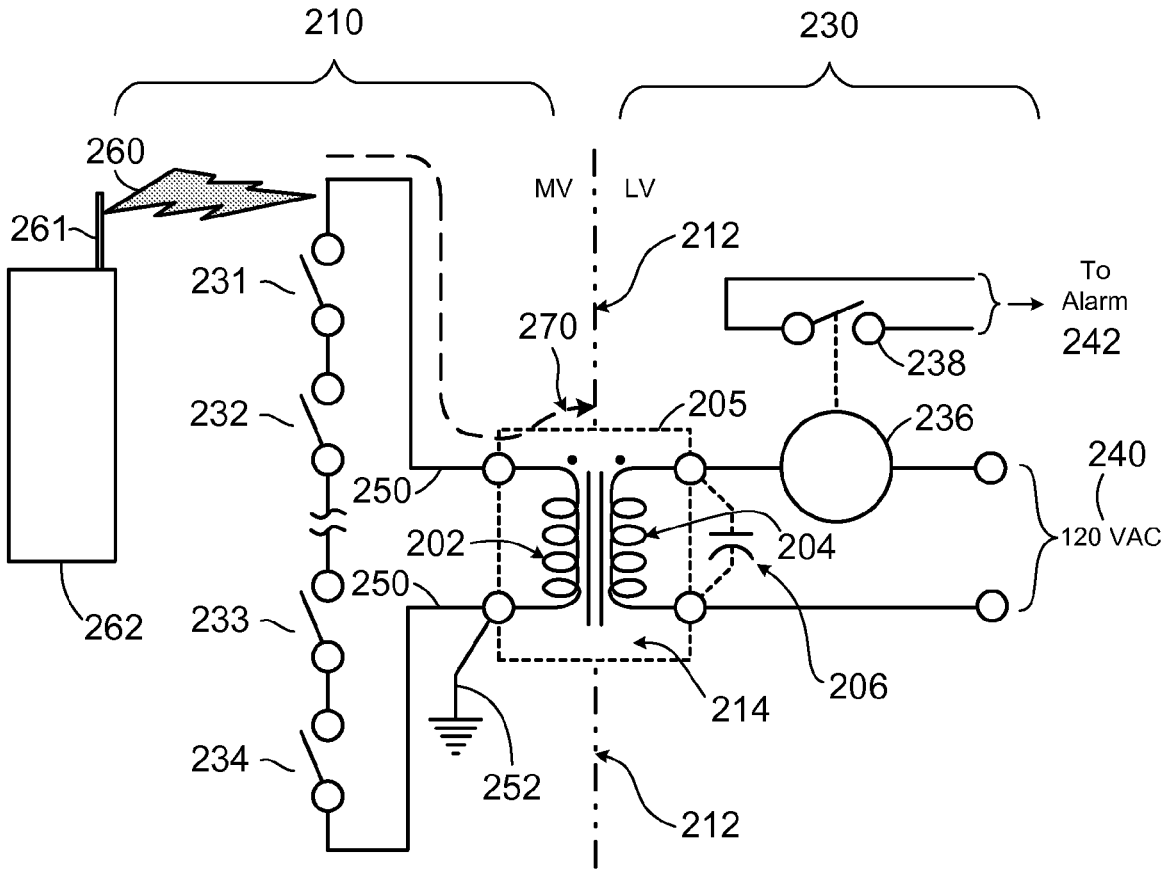
FIG. 2 illustrates various embodiments of an apparatus which includes at least one MV circuit and at least one LV circuit.

FIG. 2 illustrates various embodiments of an apparatus which includes at least one MV circuit 261 and at least one LV circuit. The apparatus of FIG. 2 includes a signal isolating transformer 205 which electrically isolates the MV compartment 210 from the LV compartment 230. In the apparatus of FIG. 2, due to the electrical isolation provided by the signal isolating transformer, each LV component within the MV compartment 210 does not need to be enclosed within a grounded metal box, and the LV wiring 250 located in the MV compartment 210 does not need to be contained within grounded metal conduit. In many applications, the apparatus of FIG. 2 is less expensive to produce than the apparatus of FIG. 1 because the cost associated with the signal isolating transformer is often less than the costs associated with enclosing the LV components within the MV compartment in metal boxes and with running the LV wiring in the MV compartment in grounded metal conduit. The signal isolating transformer 205 includes a first coil 202 which is connected to the normally-closed LV thermostats 231-234, and a second coil 204 which is connected to the LV relay 236.

As shown in FIG. 2, the first coil 202 is located on the MV side and the second coil 204 is located on the LV side. For such embodiments, a grounded metal wall 212 of the MV compartment defines an opening 214 sized to receive the signal isolating transformer 205. With this arrangement, instead of passing the LV wiring through the grounded metal wall 212 of the MV compartment, only the signal isolating transformer 205 passes through grounded metal wall 212 of the MV compartment. As used herein, metal may refer to actual metal or another conductive material. According to various embodiments, the apparatus may also include a tuning capacitor 206 connected in parallel to either the first coil 202 or the second coil 204. (FIG. 2 depicts the capacitor 206 connected in parallel to the second coil 204.) The first coil and second coil may include different numbers of turns, so that the second coil 204 contains more or less turns than the first coil 202. However, embodiments where each coil includes the same number of turns are possible.

In operation, 120 VAC control power 240 from the LV compartment is applied to the series combination of the second coil 204 and the LV relay 236 coil. If at least one of the normally-closed LV thermostats 231-234 is open due to excessive temperature, then the impedance of the second coil 204 may be much greater than the impedance of the LV relay 236 coil, and this high impedance will limit the current through the second coil 204 to less than the drop-out current of the LV relay 236 coil. However, if all of the normally-closed LV thermostats 231-234 are closed (i.e., no excessive temperature), then the resulting short-circuit across the first coil 202 may, by magnetic coupling, cause the second coil 204 to have an impedance much lower than the impedance of the LV relay 236 coil. The low impedance allows a current to flow through the second coil 204 which is greater than the pick-up current of the LV relay 236 coil, thereby energizing the LV relay 236 coil and moving the contacts of the LV relay 236 coil to a closed position which closes a control circuit 238 in the LV compartment. The opening of the LV control circuit 238 may cause an alarm signal 242 to be generated. In response to the alarm signal or in the alternative, a warning message may be displayed, the power may be interrupted, etc.

When an arcing fault in a MV circuit 261 occurs, a conductive cloud of ionized gas or plasma 260 may be generated. The plasma 260 may envelop nearby LV components (e.g., LV thermostats 231-234) and LV wiring 250 of a LV circuit located in the MV compartment. Because the insulation of the LV components 231-234 or LV wiring 250 is typically not able to withstand the high temperatures or the high voltage within the plasma 260, the insulation may fail. The failure of the insulation may create a direct connection 270 between the MV circuit and the LV circuit via the plasma 260, thereby applying MV to the LV circuit, and to any other LV circuits connected thereto.

The presence of MV on LV circuits in the MV compartment may place a large voltage over-stress on the insulation of the LV devices and LV wiring of the LV circuits. The stress may cause the insulation of LV devices and LV wiring of the LV circuits to fail, even if the LV devices 231-234 and LV wiring 250 are located in areas not directly exposed to the plasma. However, the LV circuits 231-234 and 250 affected do not directly extend beyond the MV compartment because of the separation created by the signal isolating transformer. Thus, there may be material damage to the LV circuits in the MV compartment, but the threat of a physical hazard outside of the MV compartment is greatly reduced.

When the insulation of a given LV circuit in the MV compartment fails, a path from the LV circuit to the grounded metal wall 212 may be created. The path to ground may serve to prevent the MV present on the LV circuit from being applied to other LV circuits connected thereto. When a path to ground is created, very large currents may flow through the affected LV circuit to ground. These large currents may vaporize portions of the LV wiring 250, and such vaporization may serve to prevent the MV present on the LV circuit from being applied to other LV circuits connected thereto. Optionally, one path to ground 252 may be deliberately created without affecting the normal operation.

When no path to ground is created in the LV wiring 250 between the fault location and the first coil 202 of the signal isolating transformer, the insulation between the first coil 202 and the core of the signal isolating transformer may fail, thereby resulting in the application of MV to the core. The core of the signal isolating transformer is grounded via one or more conductors. The failure of the insulation between the first coil 202 and the core will itself create a path to ground for the MV via the conductors. When such a path is created, very large currents may flow through the affected LV wiring 250 and through the conductors which connect the core to ground. Although the very large currents may vaporize the LV wiring 250, the core-grounding conductors are sized so that they will not vaporize before the affected LV wiring vaporizes or the fault is cleared by MV protective devices. Thus, absent any plasma 260 reaching the second coil 204, no MV will be applied to the second coil 204, or to any human interface devices on the LV side 230.

Figure 3A:
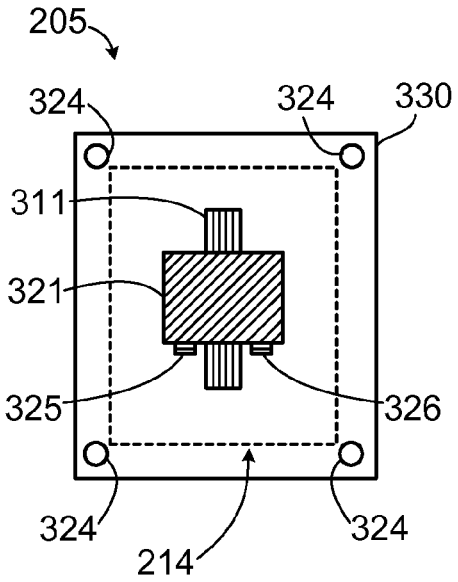
FIGS. 3A-3C illustrate various views of a signal isolating transformer of the apparatus of FIG. 2 according to various embodiments.
Figure 3B:
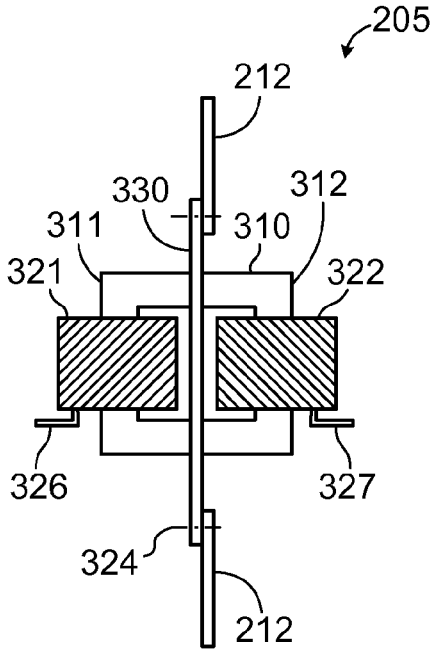
Figure 3C:
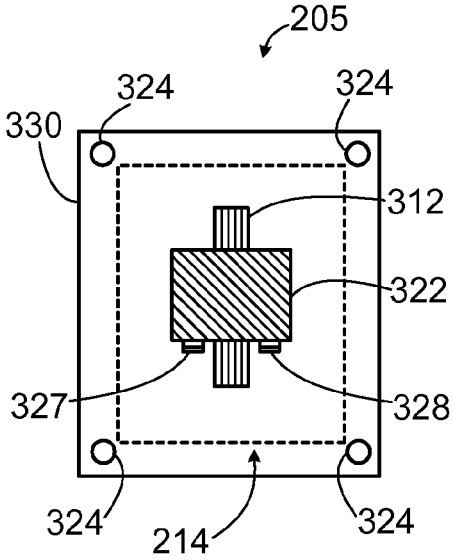

FIGS. 3A, 3B and 3C illustrate various views of a signal isolating transformer 205 of the apparatus of FIG. 2 according to various embodiments. FIG. 3A is a side view of the transformer 205, as viewed from the MV section (210 in FIG. 2). The dotted line 214 represents an opening in metal wall 212. FIG. 3B is a view of the transformer 205 as it extends through opening 214 in the metal wall 212. FIG. 3C is a side view of the transformer 205, as viewed from the LV section (230 in FIG. 2).

The signal isolating transformer includes a core 310 having a first leg 311 and a second leg 312, a first coil 321 wound around the first leg 311, a second coil 322 wound around the second leg 312, and a metal plate 330 connected to the core 310. The metal plate 330 is positioned between the first 312 and second 322 coils and extends past the core 310. The metal plate 330 is of a specified minimum thickness and is sized to completely cover the above-described opening 214 in the grounded metal wall 212 of the MV compartment. Thus, when an arcing fault occurs in the MV compartment, the metal plate prevents plasma resulting from the arc from passing from the MV side to the LV side. The metal plate 330 may be attached to the grounded metal wall of the MV compartment in any suitable manner that provides electrical conduction. For example, according to various embodiments, the metal plate may be attached to the grounded metal wall of the MV compartment by fasteners such as, for example, conductive bolts in the mounting holes 324.

The core 310 may be of any suitable shape or construction, such as box-shaped laminated steel, and it is mounted to the metal plate 330 so that the first leg 311 is on one side of the metal plate 330 and the second leg 312 is on the other side of the metal plate 330. When the metal plate 330 is attached to the grounded metal wall of the MV compartment, the first leg 311 is on the MV side and the second leg 312 is on the LV side. The core 310 may be electrically connected to the metal plate 330 so that once the metal plate 330 is attached to the grounded metal wall of the MV compartment, both the metal plate 330 and the core 310 are grounded by, for example, conductive bolts in the mounting holes 324. The metal plate 330 is configured so that it does not act as a shorted-turn on the core. For example, according to various embodiments, the metal plate 330 may define a slit which operates to prevent the metal plate 330 from acting as a shorted-turn on the core 310.

The first coil 321 may include any number of terminals 325, 326 that are electrically connected to the LV wiring on the MV side of the apparatus, while the second coil 322 may include terminals 327-328 that are electrically connected to the LV wiring on the LV side of the apparatus.

According to various embodiments, the first and second coils may have the same number of turns and the same operating voltage. According to other embodiments, the first and second coils may have a different number of turns and different operating voltages. In general, each of the first and second coils may be insulated for their own operating voltage.

With the above-described configuration, no fault current will reach the second coil directly, no plasma will reach the second coil through the metal plate, and no excessive stress will occur on the insulation of the second coil. Therefore, no potentially lethal shock hazards are created at a human interface device on the LV side.

Figure 4A:
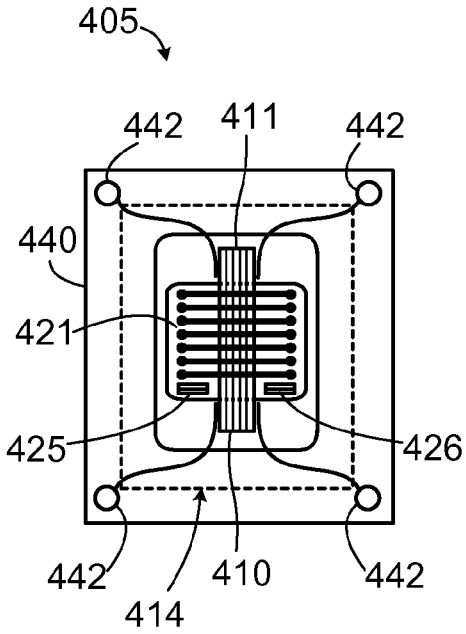
FIGS. 4A-4C illustrate various views of a signal isolating transformer of the apparatus of FIG. 2 according to other embodiments.
Figure 4B:
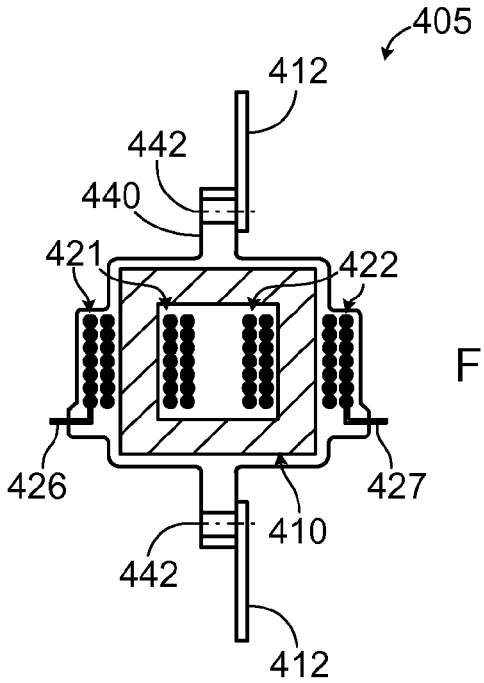
Figure 4C:
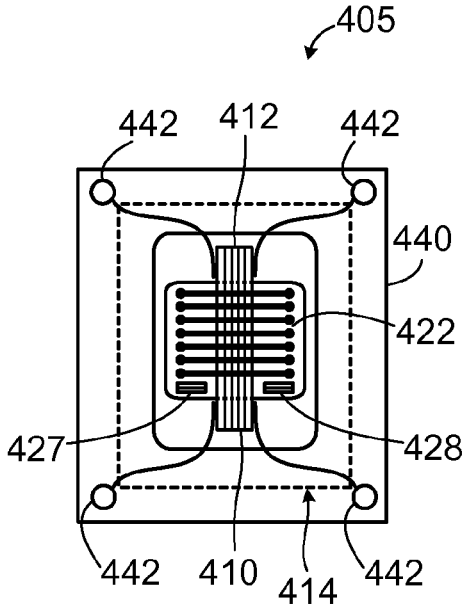

FIGS. 4A, 4B and 4C illustrate various views of a signal isolating transformer 405 according to other embodiments. The signal isolating transformer of FIG. 4 contains many elements similar to those in the signal isolating transformer of FIG. 3, but it is different in that the core 410 and the coils 421, 422 of the signal isolating transformer of FIG. 4 are encapsulated in a molded epoxy case 440 instead of being mounted to a metal plate. The molded epoxy case 440 defines a flange which fits over the opening 414 in the grounded metal wall 412 of the MV compartment. The molded epoxy case 440 includes inserts 442 made of metal or another conductive material which are molded into the flange and are configured to receive fasteners (e.g., bolts) which are utilized to attach the signal isolation transformer to the grounded metal wall of the MV compartment. The metal inserts 442 may be electrically connected to the core 410 inside the molded epoxy case 440 to provide a path to ground for current resulting from an arcing fault in a MV circuit. The flange serves to block any plasma from entering the LV compartment because the flange thickness is sufficient to resist being melted by plasma or radiation of the MV arcing fault before the MV protective devices can operate.

The first coil 421 may include any number of terminals 425, 426 that are electrically connected to the LV wiring in the MV compartment of the apparatus, while the second coil 422 may include terminals 427-428 that are electrically connected to the LV wiring in the LV compartment of the apparatus.

The signal isolating transformers shown in FIGS. 2-4 introduce additional series resistance and reactance between the LV thermostats and the LV relay that are not present in the apparatus of FIG. 1. Also, the signal isolating transformers shown in FIGS. 2-4 may draw a magnetizing current even when one or more of the LV thermostats are open. Therefore, the LV relay is typically selected based on these facts.

Figure 5:
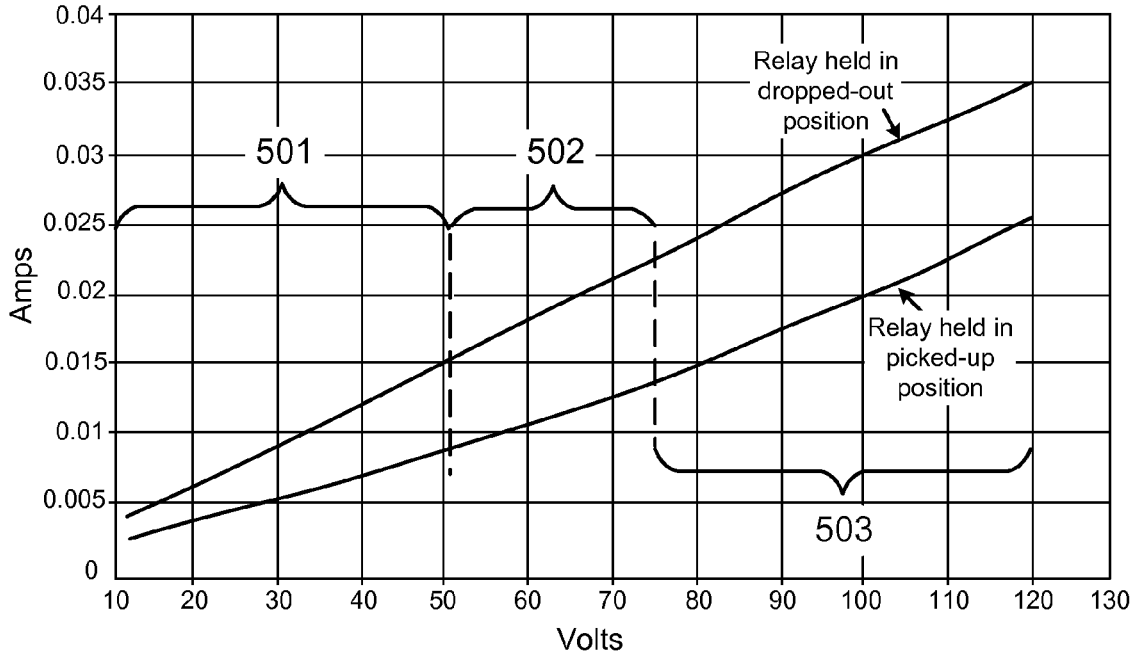
FIG. 5 discloses an exemplary test measurement made on a candidate relay according to an embodiment.

FIG. 5 shows test measurements made on an exemplary LV relay, in this case a relay manufactured by Potter & Bromfield having part number KUP-14A35-120. In FIG. 5, coil volts AC (VAC) at 60 Hz are shown on the x-axis, and the coil amps are shown on the y-axis. As shown in FIG. 5, the coil drops out in the region labeled 501 if not held. The coil chatters in the region labeled 502 if not held. In the region labeled 503, at least 75 VAC at 0.023 amps was required to cause the exemplary LV relay to pick up. The voltage drop at 0.023 amps across the added resistance and reactance due to the signal isolating transformer is added vectorially to the 75 VAC to determine the new and greater minimum pick-up value.

Also, as shown in FIG. 5, the LV relay dropped out when the current through the candidate relay coil was less than 0.008 amps. Thus, the magnetizing current due to the signal isolating transformer should be less than 0.008 amps. The magnetizing current is reactive lagging. Therefore, if the magnetizing current is too large, most of the magnetizing current may be canceled with reactive leading current by adding the optional tuning capacitor (206 in FIG. 2) in parallel with either the first coil or the second coil. FIG. 2 shows the capacitor 206 in parallel with the second coil 204.

Figure 6:
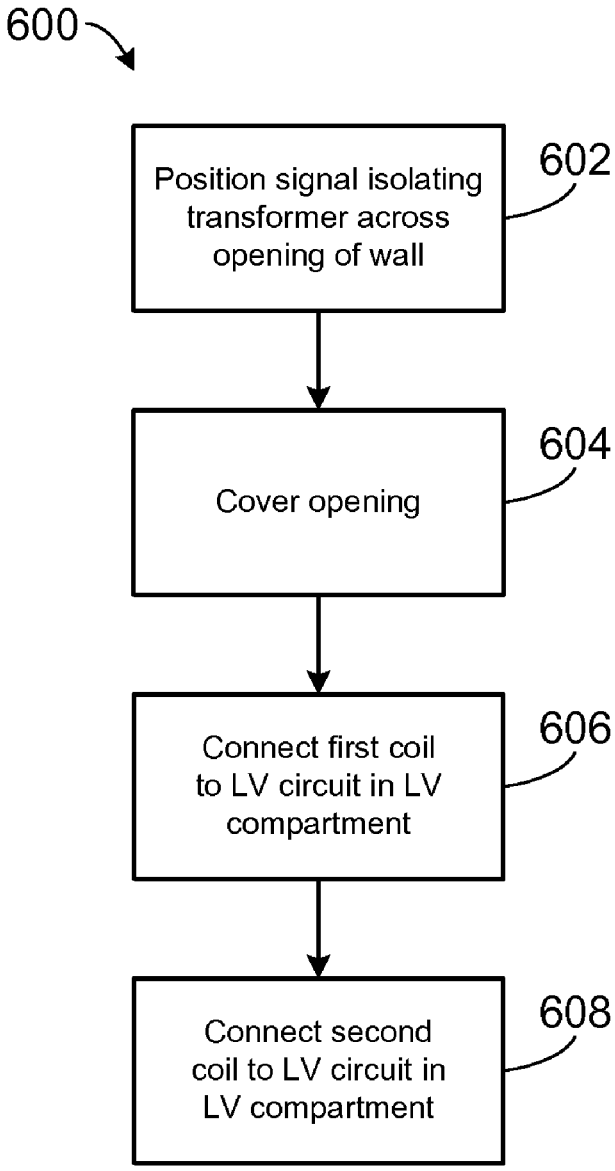
FIG. 6 illustrates various embodiments of a method of isolating a medium voltage.

FIG. 6 illustrates various embodiments of a method 600 of isolating a medium voltage. The method 600 may be utilized, for example, to isolate an arc fault in a medium voltage compartment from a human interface device external to the medium voltage compartment. The method 600 begins at block 602, where a signal isolating transformer is positioned such that a first coil of the signal isolating transformer is in the medium voltage compartment and a second coil of the signal isolating transformer is external to the medium voltage compartment. From block 602, the process advances to block 604, where an opening defined by a grounded wall of the medium voltage compartment is covered by attaching a metal plate connected to the signal isolating transformer to the grounded wall.

According to various embodiments, the process advances from block 604 to block 606, where the first coil is connected to a low voltage circuit in the medium voltage compartment. From block 606, the process may advance to block 608, where the second coil is connected to a low voltage circuit external to the medium voltage compartment.

It will be appreciated that various of the above-disclosed and other features and functions, or alternatives thereof, may be desirably combined into many other different systems or applications. In particular, any LV devices which signal their operation by opening a set of contacts can be substituted for the LV thermostats. Also it will be appreciated that various presently unforeseen or unanticipated alternatives, modifications, variations or improvements therein may be subsequently made by those skilled in the art which are also intended to be encompassed by the following claims.

What is claimed is:

1. A system, comprising:

a medium voltage compartment including at least one grounded wall that defines an opening;

a low voltage compartment adjacent to the wall;

a signal isolating transformer positioned within the opening and configured to electrically isolate the medium voltage compartment from the low voltage compartment, comprising:

a core having a first leg positioned within the medium voltage compartment and a second leg positioned within the low voltage compartment, a first coil wound around the first leg, a second coil wound around the second leg, and a conductive plate connected to the grounded wall and the core, wherein the conductive plate is positioned between the first leg and second leg and covers the opening; and a molded case which encapsulates the first coil, the second coil and the core and positions the first leg to one side of the conductive plate and the second leg to an opposing side of the conductive plate such that the first coil is within the medium voltage compartment and the second coil is within the low voltage compartment, wherein the molded case comprises a flange which covers the opening.

2. The system of claim 1, wherein the metal plate is electrically bonded to the core.

3. The system of claim 1, wherein the first coil comprises a first number of turns, a second coil comprises a second number of turns, and the first number does not equal the second number.

4. The system of claim 1, wherein the first coil comprises a first number of turns, a second coil comprises a second number of turns, and the first number equals the second number.

5. The system of claim 1, further comprising a tuning capacitor connected in parallel with the second coil.

6. The system of claim 1, further comprising a tuning capacitor connected in parallel with the first coil.

7. The system of claim 1, further comprising:

a plurality of low voltage thermostats positioned within the medium voltage compartment;

wherein the first coil is electrically connected to the thermostats.

8. The system of claim 7, wherein the thermostats function such that opening of any of the thermostats causes impedance of the second coil to increase.

9. The system of claim 7, further comprising:

a low voltage relay that is electrically connected to the second coil.

10. The system of claim 9, wherein the thermostats function such that opening of any of the thermostats causes contacts of the relay to move.

11. A system, comprising:

a medium voltage compartment, wherein the medium voltage compartment includes a wall that defines an opening;

a low voltage compartment adjacent to the wall; and a signal isolating transformer positioned within the opening and configured to electrically isolate the medium voltage compartment from the low voltage compartment, comprising:

a core having a first portion positioned within the medium voltage compartment and a second portion positioned within the low voltage compartment, a first coil wound around the first portion of the core, a second coil wound around the second portion of the core, and a molded case which encapsulates the first and second coils and the core and positions the first portion to one side of the wall and the second portion to an opposing side of the wall such that the first coil is within the medium voltage compartment and the second coil is within the low voltage compartment, wherein the molded case comprises a flange which covers the opening.

12. The system of claim 11, wherein the signal isolating transformer further comprises one or more conductive inserts electrically connected to the core inside the molded case to provide a path from the core to ground.

13. The system of claim 12, further comprising:

a plurality of low voltage thermostats positioned within the medium voltage compartment;

wherein the first coil is electrically connected to the thermostats.

14. The system of claim 13, wherein the thermostats function such that opening of any of the thermostats causes impedance of the second coil to increase.

15. The system of claim 14, further comprising:

a low voltage relay that is electrically connected to the second coil.

16. The system of claim 13, wherein the thermostats function such that opening of any of the thermostats causes contacts of the relay to move.

* * * * *